US011667139B2

(12) United States Patent
Sakurai et al.

(10) Patent No.: US 11,667,139 B2
(45) **Date of Patent: *Jun. 6, 2023**

(54) PRINTING APPARATUS, METHOD OF CONTROLLING PRINTING APPARATUS, AND STORAGE MEDIUM

(71) Applicant: CANON KABUSHIKI KAISHA, Tokyo (JP)

(72) Inventors: Norio Sakurai, Tokyo (JP); Kosuke Yamamoto, Yokohama (JP); Yuki Emoto, Tokyo (JP); Toshiaki Somano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 17/475,651

(22) Filed: Sep. 15, 2021

(65) Prior Publication Data

US 2021/0402812 A1 Dec. 30, 2021

Related U.S. Application Data

(62) Division of application No. 16/358,737, filed on Mar. 20, 2019, now Pat. No. 11,142,001.

(30) Foreign Application Priority Data

Mar. 27, 2018 (JP) ..... JP2018-060491

(51) Int. Cl.
*B41J 13/00* (2006.01)
*B41J 11/00* (2006.01)

(52) U.S. Cl.
CPC ..... *B41J 13/0036* (2013.01); *B41J 11/002* (2013.01)

(58) Field of Classification Search
CPC ..... B41J 13/0036; B41J 11/002
See application file for complete search history.

(56) References Cited

U.S. PATENT DOCUMENTS

| | | | | |
|---|---|---|---|---|
| 9,039,161 | B2 | 5/2015 | Itogawa | |
| 10,073,402 | B2 | 9/2018 | Takuwa | |
| 11,142,001 | B2 * | 10/2021 | Sakurai | B41J 11/002 |
| 2006/0263130 | A1 | 11/2006 | Shin | |
| 2007/0228649 | A1 | 10/2007 | Mizutani et al. | |

(Continued)

FOREIGN PATENT DOCUMENTS

| | | | |
|---|---|---|---|
| JP | 2002-278186 | A | 9/2002 |
| JP | 2004-050706 | A | 2/2004 |

(Continued)

OTHER PUBLICATIONS

Office Action dated Aug. 24, 2021, in Japanese Patent Application No. 2018-060491.

*Primary Examiner* — Julian D Huffman
(74) *Attorney, Agent, or Firm* — Venable LLP

(57) ABSTRACT

A printing apparatus can prevent a print medium from buckling during discharging. In a case in which the print conveyance speed determined by the print mode is higher than or equal to a specified speed, the print medium after printing is conveyed to a discharging tray at the print conveyance speed, and in a case in which the print conveyance speed determined by the print mode is lower than the specified speed, the print medium after printing is conveyed to the discharging tray at the specified speed increased from the print conveyance speed.

15 Claims, 14 Drawing Sheets

(56) References Cited

U.S. PATENT DOCUMENTS

| | | | |
|---|---|---|---|
| 2009/0141053 | A1 | 6/2009 | Dahlgren |
| 2012/0249649 | A1 | 10/2012 | Morita et al. |
| 2014/0092162 | A1 | 4/2014 | Nishihara |

FOREIGN PATENT DOCUMENTS

| | | | |
|---|---|---|---|
| JP | 2004-322326 | A | 11/2004 |
| JP | 2005-195650 | A | 7/2005 |
| JP | 2007-271854 | A | 10/2007 |
| JP | 2012-206815 | A | 10/2012 |
| JP | 2013-208754 | A | 10/2013 |
| JP | 2018-034981 | A | 3/2018 |

* cited by examiner

| FIG.11A |
| --- |
| FIG.11B |

| FIG.12A |
| --- |
| FIG.12B |

PRINTING APPARATUS, METHOD OF CONTROLLING PRINTING APPARATUS, AND STORAGE MEDIUM

BACKGROUND OF THE INVENTION

Field of the Invention

The present invention relates to printing apparatuses to perform printing on sheet-shaped print media that are conveyed and methods of controlling the printing apparatuses, and storage media storing programs for controlling the printing apparatuses.

Description of the Related Art

Japanese Patent Laid-Open No. 2002-278186 discloses techniques in which the conveyance speeds on the upstream side and on the downstream side of the image forming portion are different from the conveyance speed at the image forming portion. For example, in a technique disclosed in Japanese Patent Laid-Open No. 2002-278186, the conveyance speed of the print medium after printing is increased when there is no succeeding print medium, to shorten the retention time of the print medium within the conveying path, and thus to improve the throughput. When there is a succeeding print medium, the print medium after printing is conveyed at a constant conveyance speed with no change to make favorable the stacking performance of the print medium at the discharge position.

Meanwhile, since the inkjet printing apparatus performs printing by applying ink to the print media, the applied ink penetrates the print medium. Thus, depending on the amount of ink applied, changes in the physical properties of the print medium occur, such as the decrease in the rigidity and the increase in the friction coefficient. If the technique in Japanese Patent Laid-Open No. 2002-278186 is applied to such inkjet printing apparatuses, when a print medium with changed physical properties is conveyed and discharged at the same conveyance speed as the one at the image forming portion, the print medium may buckle at the discharge position. This may cause jamming at the discharge position when printing is performed continuously on print media.

SUMMARY OF THE INVENTION

The present invention has been made in light of the above problem, and an object thereof is to provide a printing apparatus that prevents a print medium from buckling during discharging, a method of controlling a printing apparatus, and a storage medium.

In a first aspect of the present invention, there is provided a printing apparatus comprising:

a print head configured to perform printing on a print medium based on print data;

a conveying unit configured to convey the print medium at a print conveyance speed determined based on a print mode;

a discharging tray that the print medium on which printing has been performed by the print head is discharged on; and a conveyance control unit configured to control the conveying unit such that in a case where the print conveyance speed is higher than or equal to a specified speed, the conveying unit discharges the print medium at the print conveyance speed, and in a case where the print conveyance speed is lower than the specified speed, speed of the print medium is increased from the print conveyance speed to the specified speed when the conveying unit discharges the print medium.

In a second aspect of the present invention, there is provided a method of controlling a printing apparatus including:

a print head configured to perform printing on a print medium based on print data, a conveying unit configured to convey the print medium at a print conveyance speed determined based on a print mode, and a discharging tray that the print medium on which printing has been performed by the print head is discharged on, the method comprising:

a conveyance control step of controlling the conveying unit such that in a case where the print conveyance speed is higher than or equal to a specified speed, the conveying unit discharges the print medium at the print conveyance speed, and in a case where the print conveyance speed is lower than the specified speed, speed of the print medium is increased from the print conveyance speed to the specified speed when the conveying unit discharges the print medium.

In a third aspect of the present invention, there is provided a non-transitory computer readable storage medium storing a program for causing a computer to perform a method of controlling a printing apparatus including:

a print head configured to perform printing on a print medium based on print data, a conveying unit configured to convey the print medium at a print conveyance speed determined based on a print mode, and a discharging tray that the print medium on which printing has been performed by the print head is discharged on, the method comprising:

causing a computer included in the printing apparatus to perform a conveyance control step of controlling the conveying unit such that in a case where the print conveyance speed is higher than or equal to a specified speed, the conveying unit discharges the print medium at the print conveyance speed, and in a case where the print conveyance speed is lower than the specified speed, speed of the print medium is increased from the print conveyance speed to the specified speed when the conveying unit discharges the print medium.

The present invention makes it possible to discharge a print medium, the rigidity of which has decreased or the friction coefficient of which has increased due to the penetration of ink, without causing buckling.

Further features of the present invention will become apparent from the following description of exemplary embodiments with reference to the attached drawings.

DESCRIPTION OF THE EMBODIMENTS

Hereinafter, with reference to the attached drawings, description will be provided in detail for examples of printing apparatuses, methods of controlling a printing apparatus, and a storage medium, according to the present invention.

First Embodiment

Figure 1:
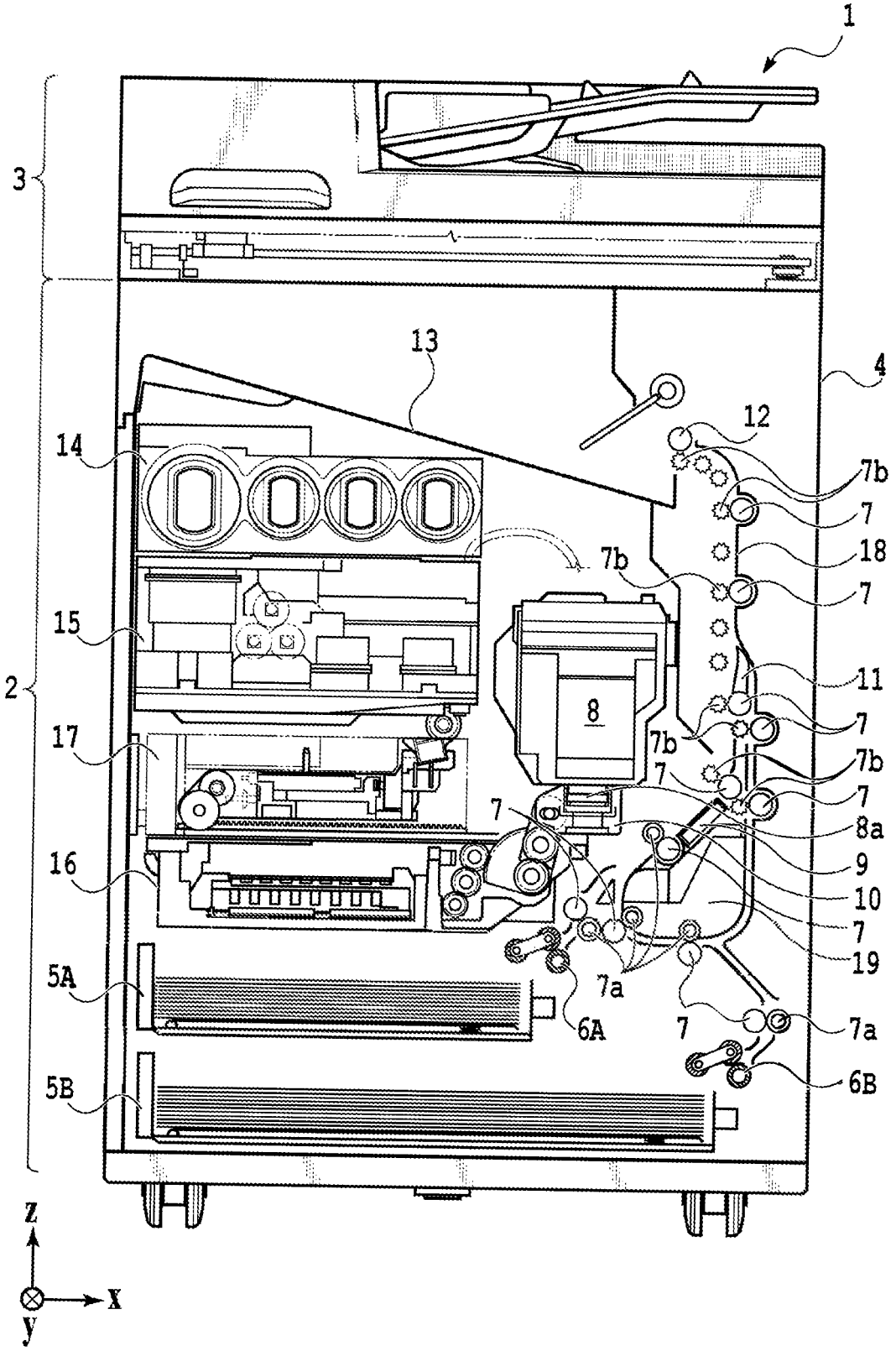
FIG. 1 is a view of a printing apparatus in a standby state.

With reference to FIGS. 1 to 10, description will be provided for a first embodiment of a printing apparatus according to the present invention. FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed seamier (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing printing media (cut sheets) S are detachably provided at the bottom of a casing 4 in the vertical direction. Relatively small printing media of up to A4 size are stacked and housed in the first cassette 5A and relatively large printing media of up to A3 size are stacked and housed in the second cassette 5B. A first feeding unit 6A for feeding housed printing media one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The printing apparatus 1 has multiple motors for driving the above drive rollers, and each drive roller is connected to one of the motors. The relationship between the motors and the drive roller will be described later in detail.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing printing media S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. That is, the print head is configured to eject inks of a plurality of colors. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
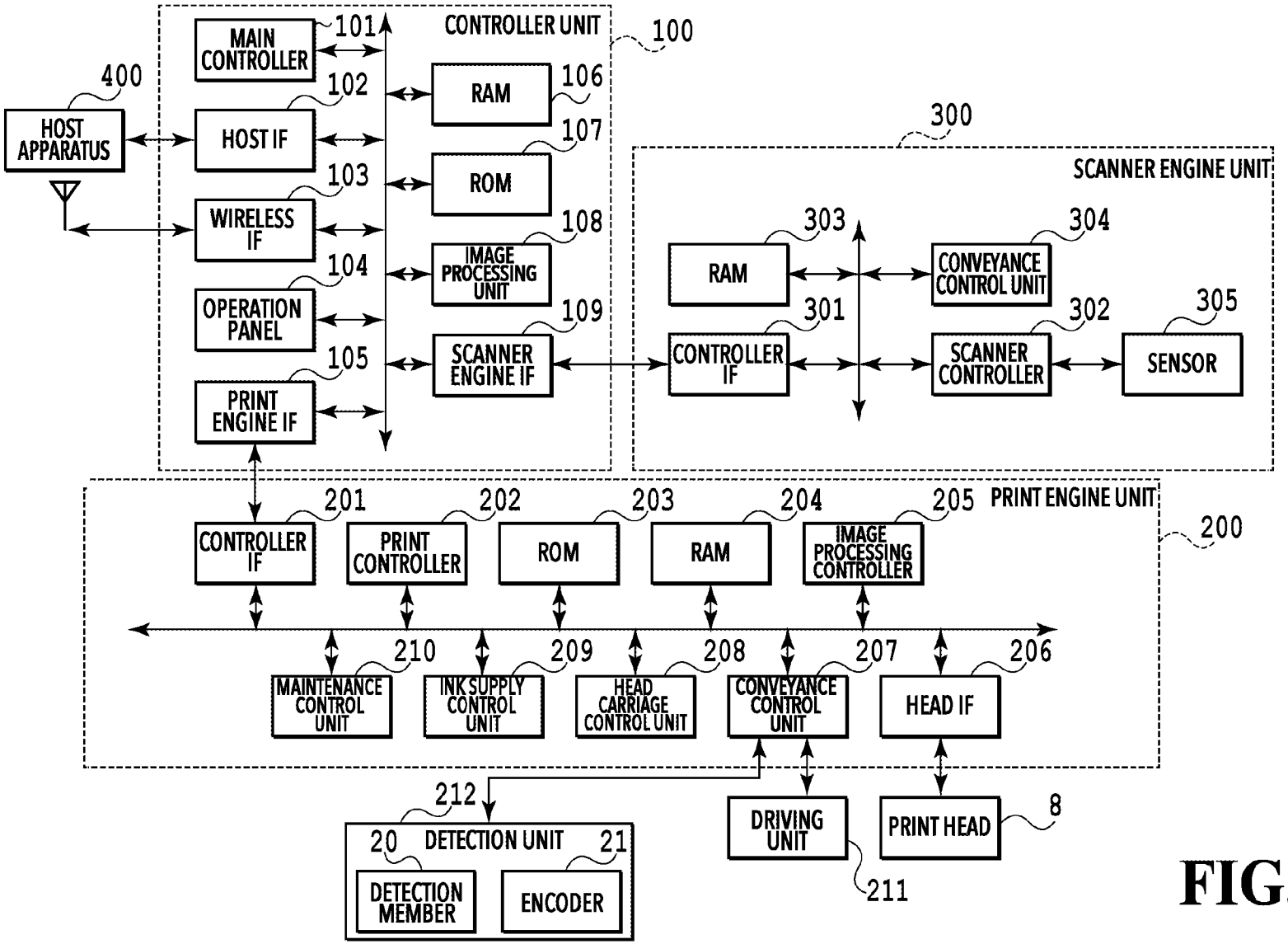
FIG. 2 is a diagram of a control configuration of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to perform input and output for the printing apparatus 1. A user can give an instruction to perform an operation such as copying or scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

The conveyance control unit 207, connected to the detection unit 212 for detecting the conveyance state of the printing medium S and the drive unit 211 for driving the drive rollers, controls the conveyance of the printing medium S using the drive unit 211, based on detection results obtained from the detection unit 212. The detection unit 212 has the detection members 20 for detecting the printing medium S and the encoders 21 for detecting the amount of rotation of the drive rollers.

Print operation by the print head 8 is performed in conjunction with conveyance operation of print medium S under instructions from the print controller 202 in the course of the conveyance of the printing medium S by the conveyance control unit 207.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
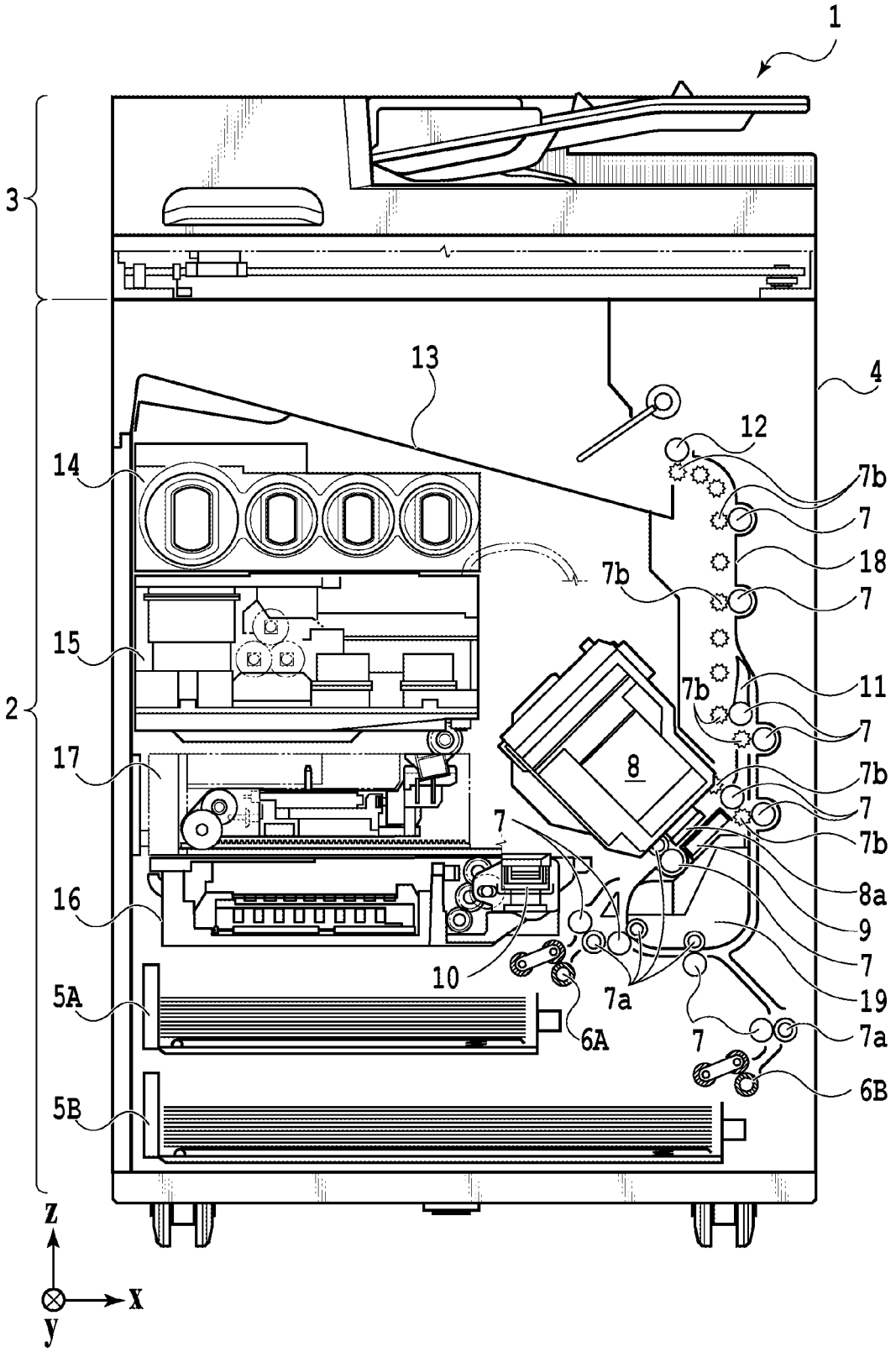
FIG. 3 is a view of the printing apparatus in a print state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member (not shown) of the cap unit 10 from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
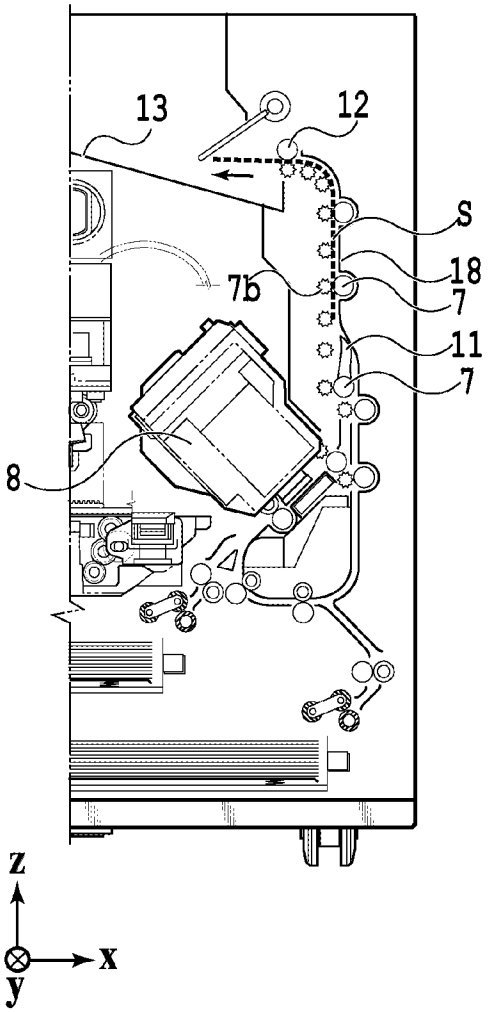
FIG. 4A, FIG. 4B, and FIG. 4C are views of a conveying path of a print medium fed from a first cassette.
Figure 4B:
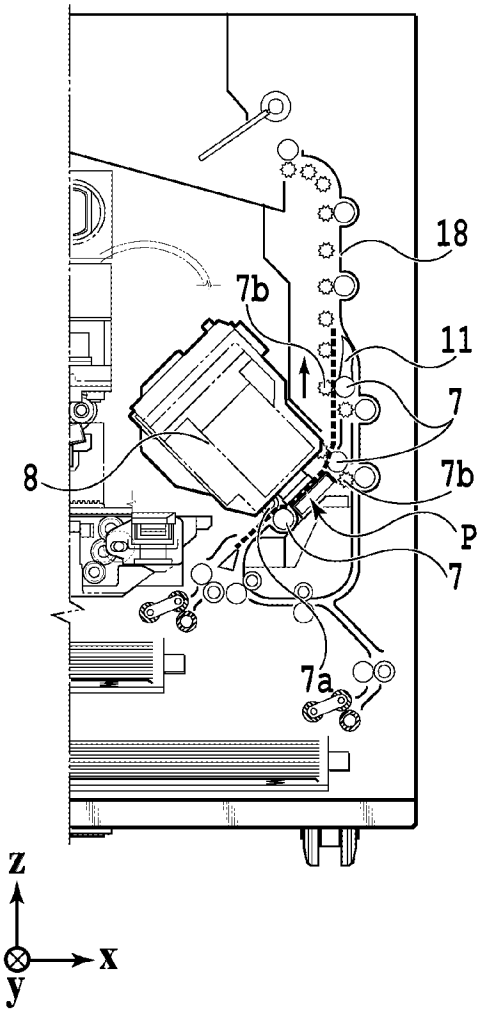
Figure 4A:
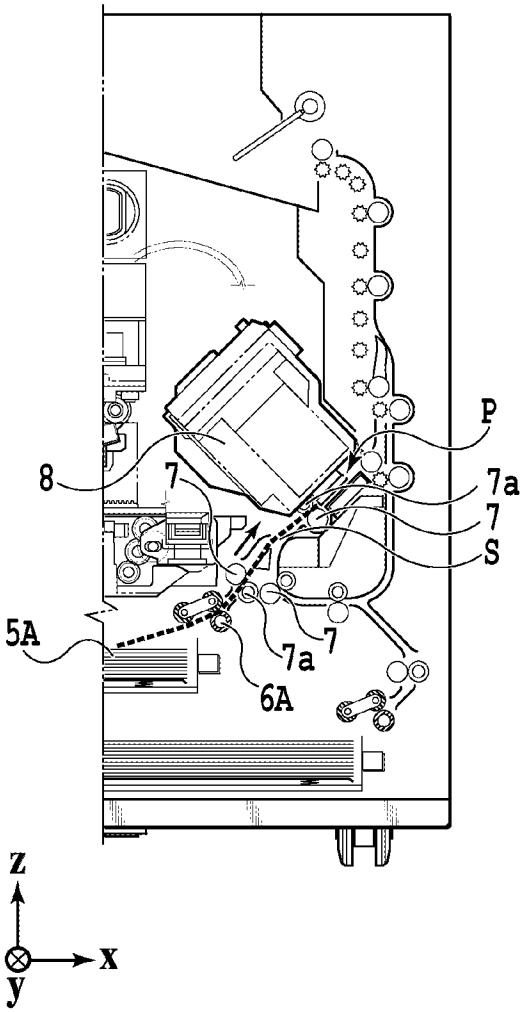

FIGS. 4A to 4C are diagrams showing a conveying path in the case of feeding an A4 size print medium S from the first cassette 5A. A print medium S at the top of a stack of printing media in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharge mode of the print medium S in this case is what is called a face-down discharging in which the print medium S is discharged with the printed surface facing down (toward the discharging tray 13) and held on the discharging tray 13.

Figure 5C:
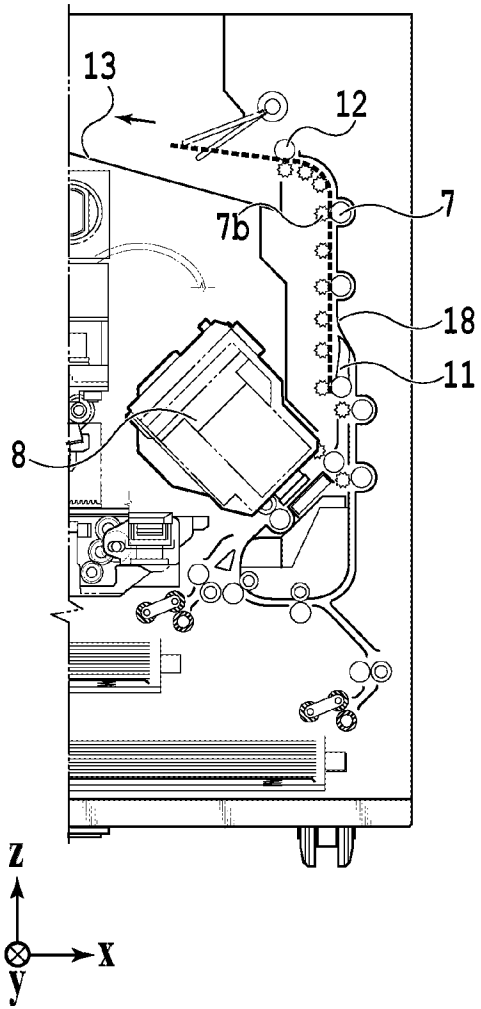
FIG. 5A, FIG. 5B, and FIG. 5C are views of a conveying path of a print medium fed from a second cassette.
Figure 5B:
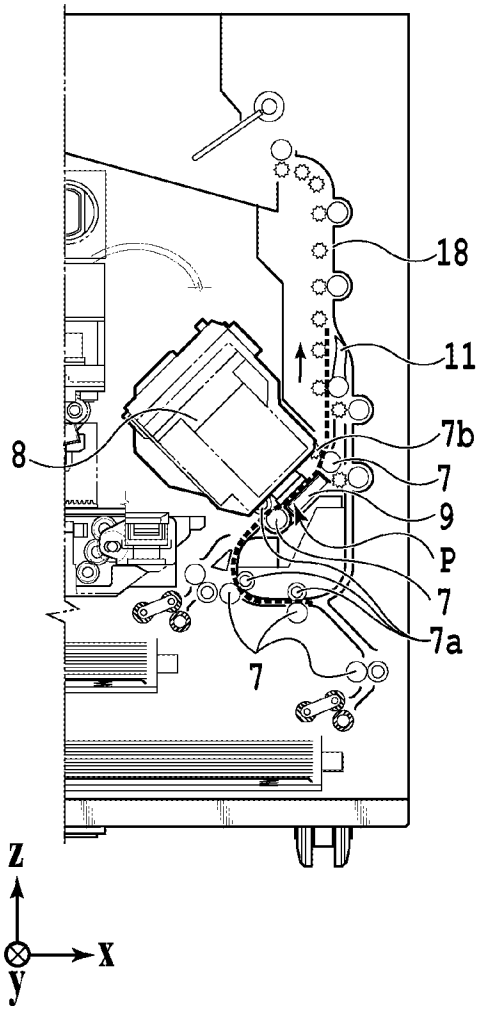
Figure 5A:
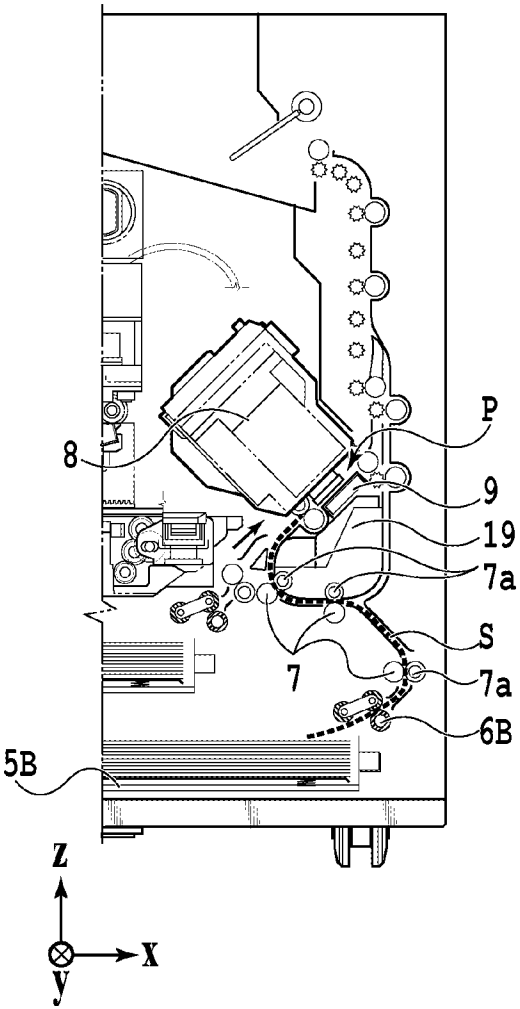

FIGS. 5A to 5C are diagrams showing a conveying path in the case of feeding an A3 size print medium S from the second cassette 5B. A print medium S at the top of a stack of printing medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The conveying path after that and the discharge mode are the same as those in the case of A4-size print media S illustrated in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figure 6D:
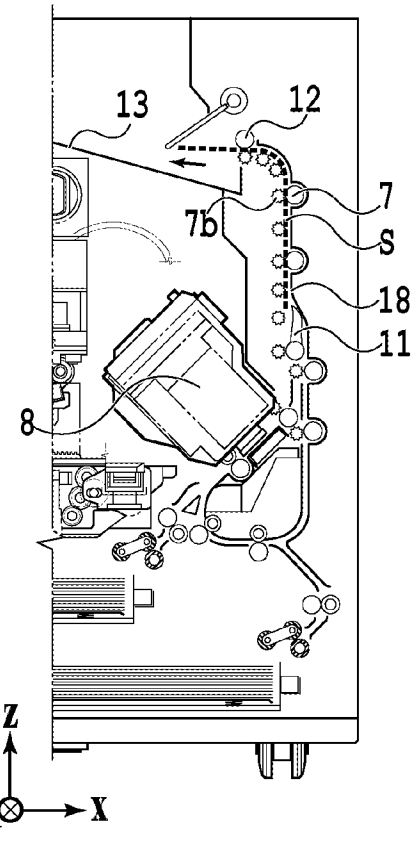
FIG. 6A, FIG. 6B, FIG. 6C, and FIG. 6D are views of a conveying path used in a case of performing a print operation on the back surface of a print medium.
Figure 6C:
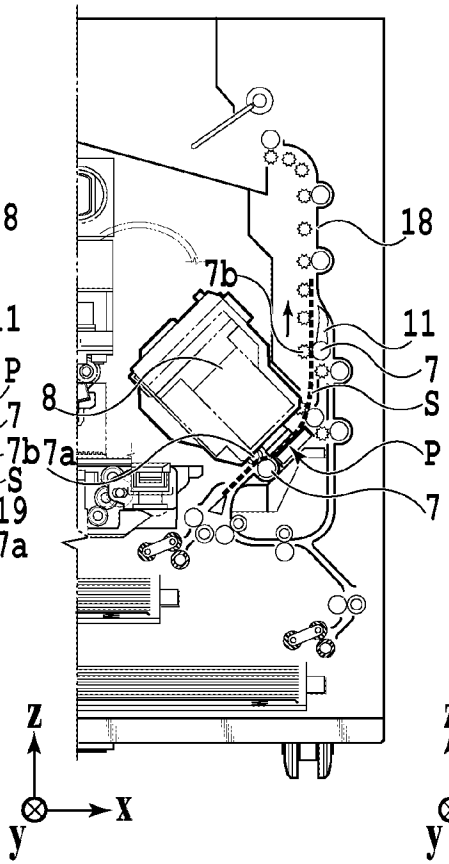
Figure 6B:
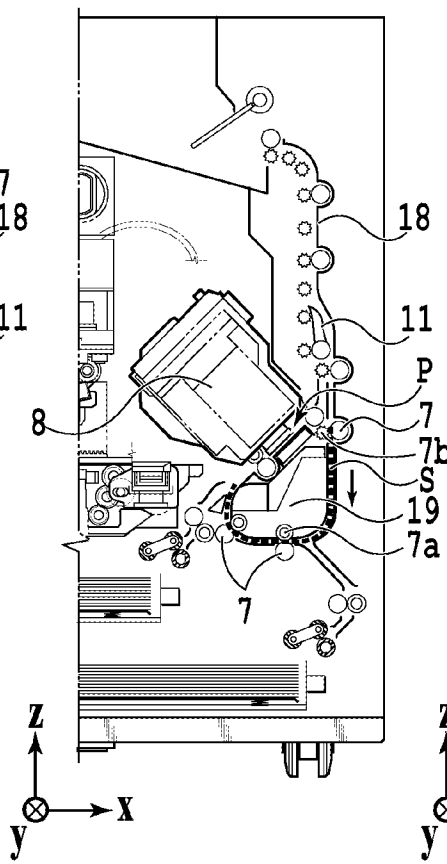
Figure 6A:
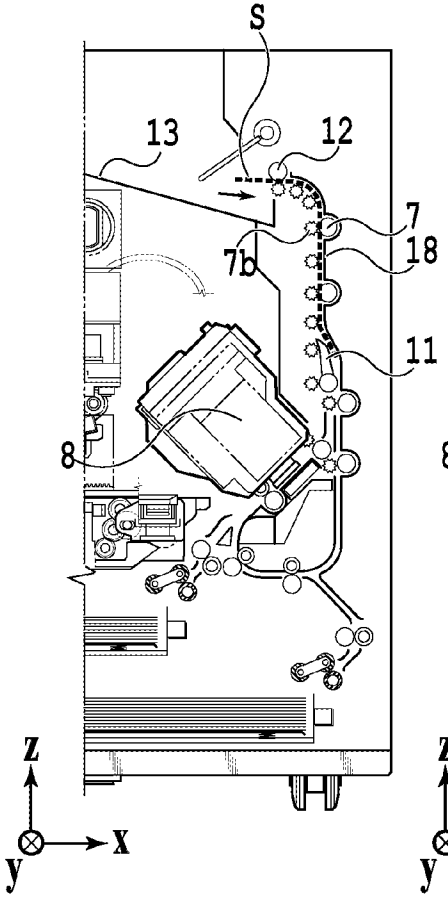

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The conveying path after that and the discharge mode are the same as those in the case of the first-surface printing illustrated in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
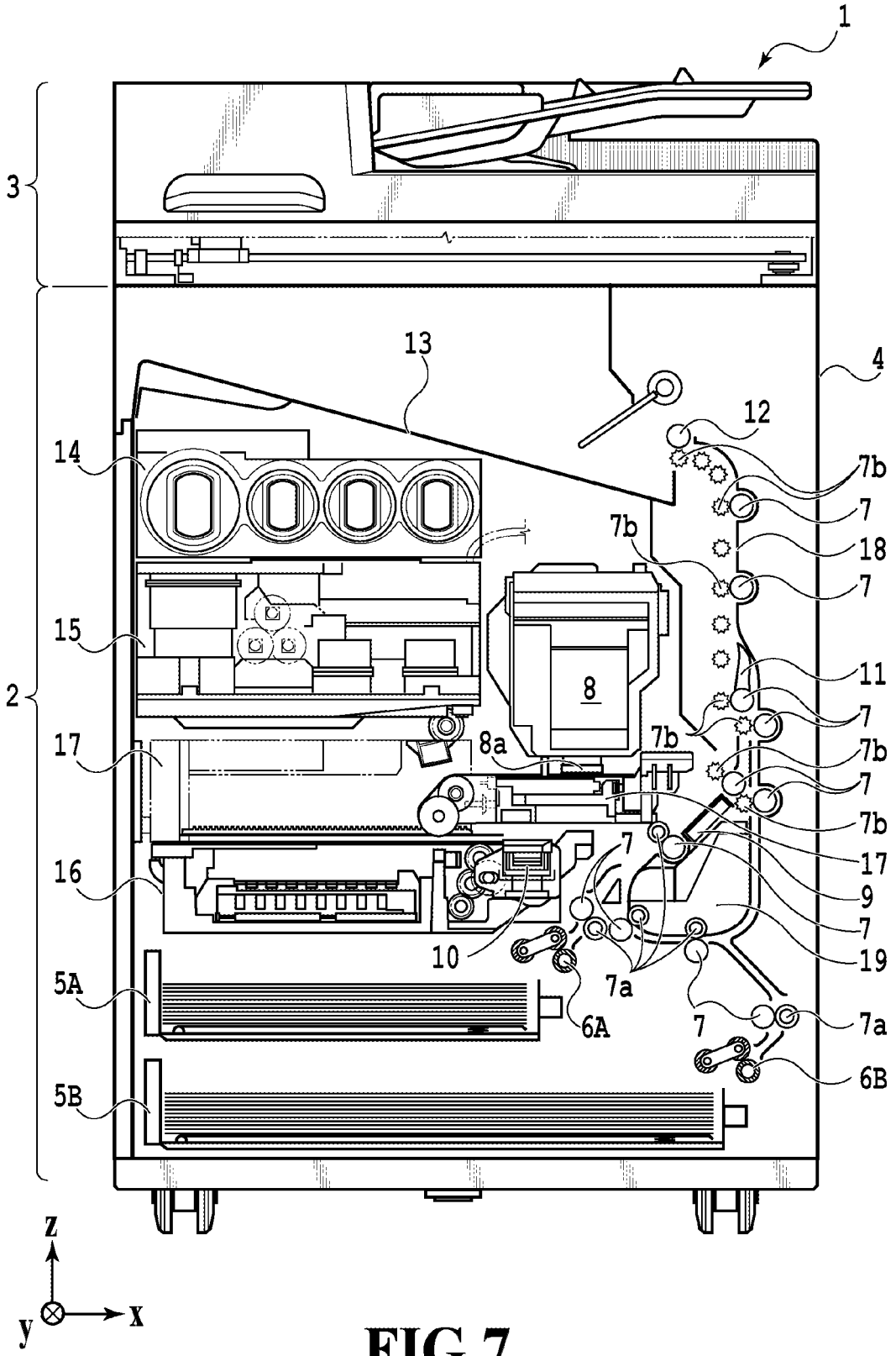
FIG. 7 is a view of the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
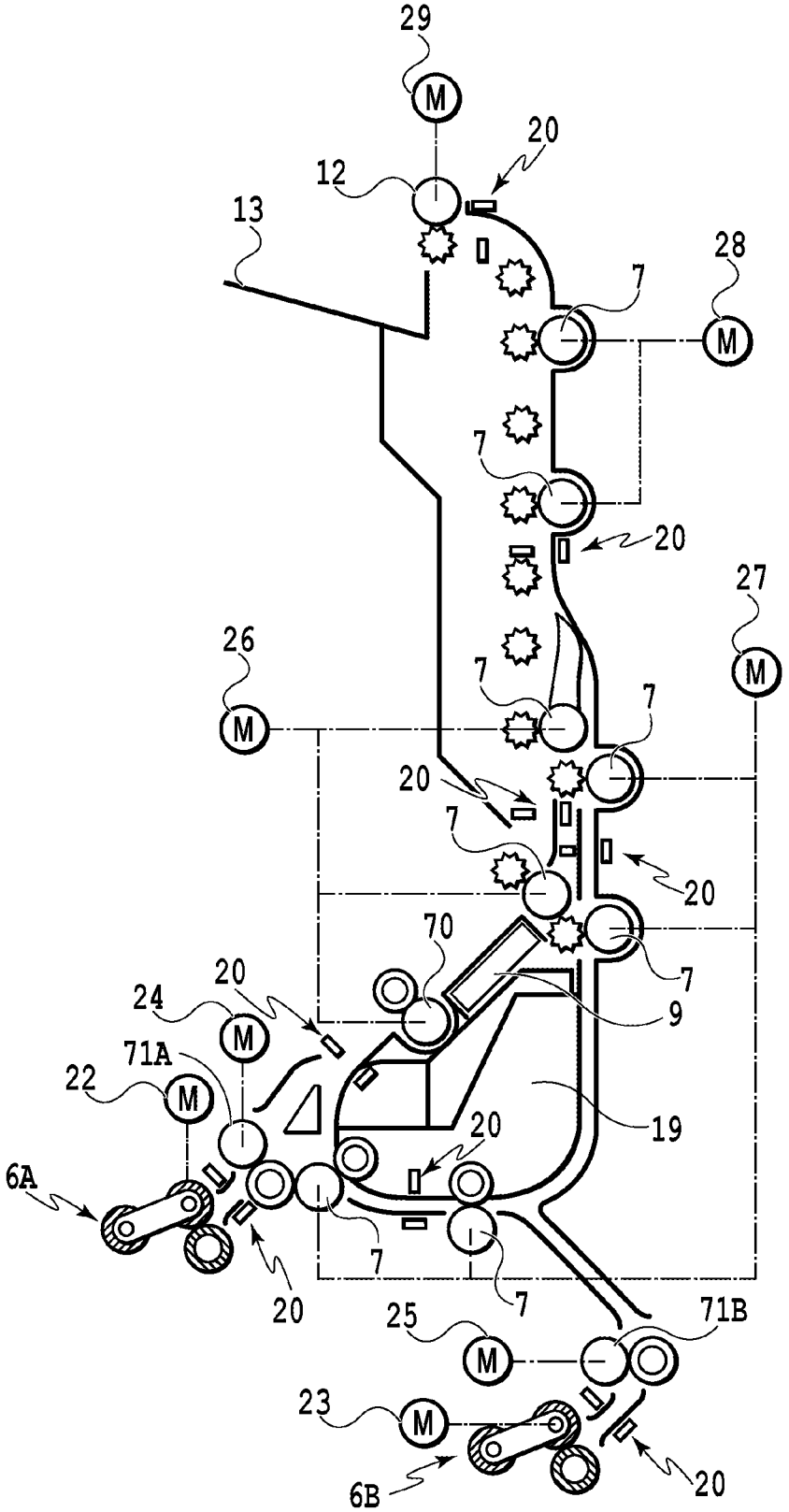
FIG. 8 is a diagram illustrating the relationship between drive rollers and motors.

FIG. 8 is a diagram illustrating the relationships between multiple motors and drive rollers in the printing apparatus 1. A first feeding motor 22 drives the first feeding unit 6A for feeding printing media S from the first cassette 5A. A second feeding motor 23 drives the second feeding unit 6B for feeding printing media S from the second cassette 5B. A first conveying motor 24 drives a first intermediate roller 71A which first conveys a printing medium S fed by the first feeding unit 6A. A second conveying motor 25 drives a second intermediate roller 71B which first conveys a printing medium S fed by the second feeding unit 6B.

A main conveying motor 26 drives a main conveying roller 70 which is disposed upstream of the platen 9 and mainly conveys the printing medium S being printed. The main conveying motor 26 also drives two conveying rollers 7 that are disposed downstream of the platen 9 and conveys the printing medium S conveyed by the main conveying roller 70, further downstream.

A third conveying motor 27 drives two conveying rollers 7 that convey downward the printing medium S, the first side of which has been printed. The third conveying motor 27 also drives two conveying rollers 7 disposed along the inner guide 19. These two conveying rollers 7 convey, toward the print head 8, a printing medium S fed from the second cassette 5B and conveyed by the second intermediate roller 71B or a printing medium S, the first side of which has been printed and the front and back sides of which have been reversed.

A fourth conveying motor 28 drives two conveying rollers 7 that convey upward or downward a printing medium S that has been printed. A discharging motor 29 drives a discharging roller 12 for discharging a printing medium S that has been printed, to the discharging tray 13. As described above, the two feeding motors 22 and 23, the five conveying motors 24 to 28, and the discharging motor 29 each are associated with one or more drive rollers.

In addition, at eight positions along the conveying path are disposed detection members 20 for detecting the printing medium S. Each detection member 20 includes a sensor and mirror disposed on opposite sides of the conveying path. The sensor having a light emitting unit and a light receiving unit is disposed on one side of the conveying path, and the mirror is disposed on the other side of the conveying path, at a position facing the sensor. Each detection member 20 checks whether the light receiving unit has detected light emitted from the light emitting unit of the sensor and then reflected by the mirror to judge if a printing medium S is present, in other words, if the leading edge or the trailing edge has passed.

The conveyance control unit 207 drives the feeding motors 22 and 23, the conveying motors 24 to 28, and the discharging motor 29 separately based on detection results of the multiple detection members 20 and the output values of encoders for detecting the amount of rotation of the drive rollers, and thus controls the conveyance operation of the entire apparatus.

The printing apparatus 1 has multiple print modes to provide printed products or print results according to the purposes, such as high productivity or high image quality. Examples of the print modes include a standard mode, high-image-quality mode, high-speed mode, silent mode, transfer suppression mode, curl suppression mode, and power suppression mode. It is assumed in this embodiment that the printing apparatus 1 has, as its print mode, a standard mode, and at least one of other print modes.

The standard mode is a print mode in which the image quality and the productivity of printed products are well balanced by providing standard image quality, standard productivity, and the like. The high-image-quality mode is a print mode that provides printing with a higher image quality than the standard mode by reducing the conveyance speed but with lower productivity. The high-speed mode is a print mode that provides printing with higher productivity than the standard mode by increasing the conveyance speed but with lower image quality. The silent mode is a print mode that provides printing with low operation noise of the apparatus by reducing the conveyance speed.

The transfer suppression mode is a print mode in which the transfer of ink from a print medium S being discharged is suppressed. Generally, the more time passes after ink is ejected onto a print medium S, such as print paper, the more firmly the ink is fixed to the print medium 5, and thus reducing the chance of the ink being transferred to another print medium S when the print medium S is stacked. Therefore, in the transfer suppression mode, the print medium S is retained in the conveying path by reducing the conveyance speed, to obtain time for the ink to be fixed on the print medium S.

The curl suppression mode is a print mode in which curling of a print medium S being discharged is suppressed. Typically, the degree of curl of a print medium S, such as print paper, is largest during ink penetration, and the degree of the curl decreases over time after that. Thus, in the curl suppression mode, the print medium S after printing is retained within the conveying path for a certain time by reducing the conveyance speed. The power suppression mode is a print mode that suppresses the power consumption of the print head 8 per unit time in high-density printing in which the print head 8 needs to drive a large number of nozzles simultaneously, by reducing the conveyance speed.

Note that the print modes of the printing apparatus 1 are not limited to the print modes described above but may include various known print modes. The print mode may be set automatically by the main controller 101 or the print controller 202 based on information on printing or may be set by the user's selection. The information on printing means various information necessary when the printing apparatus 1 performs printing on a print medium S, such as print data, the kind of the print medium S, the size of the print medium S, the print quality grade, and the resolution. The information on printing is inputted via the host apparatus 400 or the operating panel 104.

The conveyance speed in printing is set in each print mode. The conveyance speed in printing in this embodiment is defined as the conveyance speed at which a print medium fed from the cassette 5A or 5B is conveyed to a specified position (to be described later). Note that the specific conveyance speed in printing in each print mode varies depending on the configuration of the printing apparatus 1, the kind of the print medium S, the surrounding environment, the print image (the amount of ink applied), and other factors. Among the conveyance speeds in the print modes, the conveyance speed in the high-speed mode is fastest, and the one in the standard mode is the second. The conveyance speed is lower in the high-image-quality mode, silent mode, transfer suppression mode, curl suppression mode, and power suppression mode than in the standard mode. Generally, the productivity for printed products is approximately proportional to the conveyance speed in printing.

Meanwhile, the greater the amount of ink applied to a print medium S, the more the print medium S on which ink has been ejected changes in its physical properties because of the penetration of the ink. Specifically, the greater the amount of ink applied to a print medium S, the lower its rigidity and the higher its friction coefficient. In the case where the print medium S is print paper, the print medium S readily buckles, particularly for what is called short grain paper, in which the direction of paper grain formed during a print paper production process is orthogonal to the conveyance direction, and thin paper, the paper weight of which is lighter than, for example, 64 $g/m^2$, because these are extremely low in the rigidity (elasticity). In addition, regardless of the amount of ink applied, the rigidity decreases while the friction coefficient increases in high humidity environment because the print medium S absorbs moisture in the air. In other words, the physical properties of the print medium S vary depending on the kind of the print medium S, the amount of ink applied, the surrounding environment (humidity), and other factors.

Figure 9A:
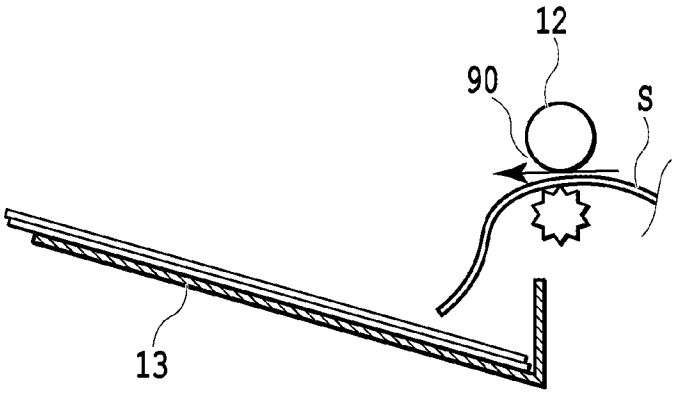
FIG. 9A, FIG. 9B, FIG. 9C and FIG. 9D are diagrams for explaining buckling of a print medium that occurs depending on the conveyance speed.
Figure 9B:
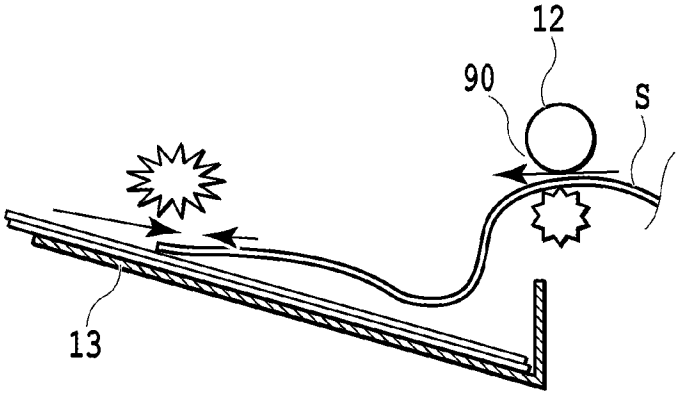
Figure 9C:
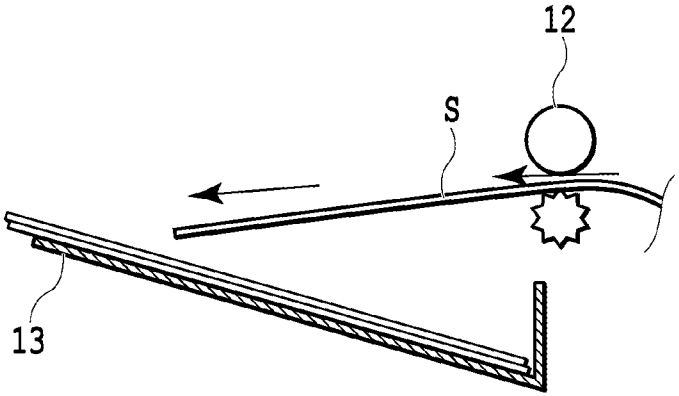
Figure 9D:
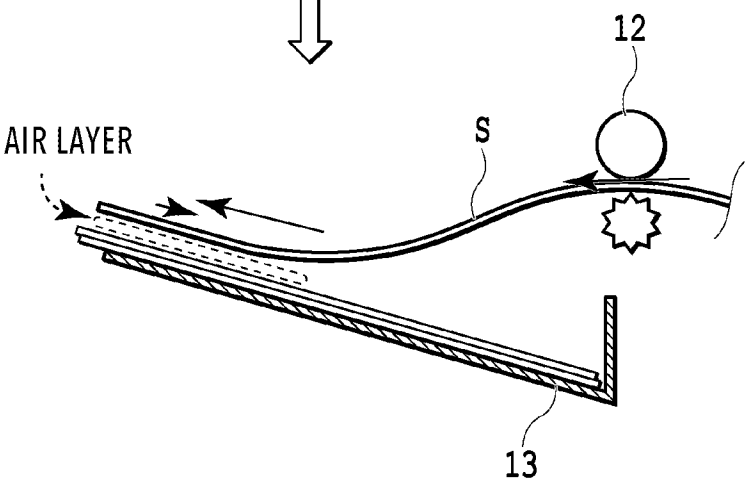

Here, description will be provided for a case where a print medium S, the rigidity of which has decreased and the friction coefficient of which has increased, buckles and a case where it does not, with reference to FIGS. 9A to 9C. FIG. 9A is an explanatory diagram illustrating a print medium S, the rigidity of which has decreased, being discharged at a low conveyance speed. FIG. 9B is an explanatory diagram illustrating the print medium S further discharged from the state in FIG. 9A. FIG. 9C is an explanatory diagram illustrating a print medium S, the rigidity of which has decreased, being discharged at a high conveyance speed. FIG. 9D is an explanatory diagram illustrating the print medium S further discharged from the state in FIG. 9C.

When a print medium S having a low rigidity is conveyed at a low conveyance speed, the leading end of the print medium S being discharged comes into contact with the discharging tray 13 or a print medium S stacked on the discharging tray 13 at a position closer to a discharge opening 90 (see FIG. 9A). In addition, since the friction coefficient of the print medium S is high, the print medium S being discharged does not slide very easily on the discharging tray 13 or the print medium S stacked on the discharging tray 13. As a result, for a low conveyance speed, the print medium S being discharged is most likely to bend and buckle (see FIG. 9B).

On the contrary, when a print medium S having a low rigidity is conveyed at a high conveyance speed, the leading end of the print medium S being discharged is likely to come into contact with the discharging tray 13 or a print medium S stacked on the discharging tray 13 at a position far from the discharge opening 90 (see FIG. 9C). As compared to the case of a low conveyance speed, a large amount of an air layer remains between the print medium S and the contact surface (the contact surface between the print medium S being discharged and the discharging tray 13 or the print medium S stacked on the discharging tray 13). As a result, even though the friction coefficient of the print medium S being discharged is high, the air layer reduces the friction force between the print medium S and the contact surface, and thus the print medium S will not buckle (see FIG. 9D).

For this reason, the printing apparatus 1 according to the present invention conveys the print medium S at a high conveyance speed in the print modes in which the conveyance speed is lower than a specified speed, to suppress the occurrence of buckling.

Figure 10:
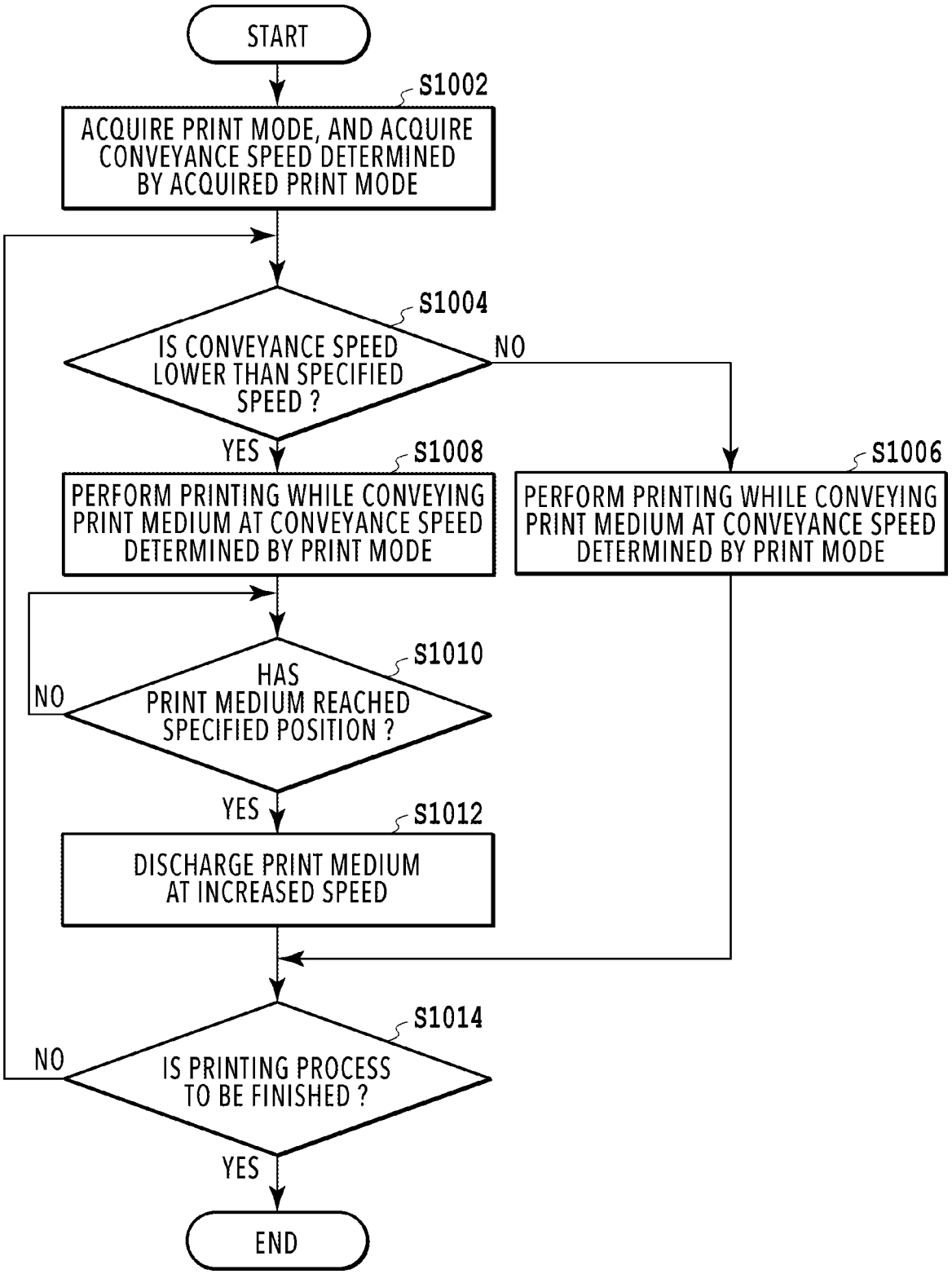
FIG. 10 is a flowchart for explaining a first embodiment.

With the configuration above, when the user gives an instruction via the operating panel 104 or the like to start printing on the print medium S, the printing process starts. FIG. 10 is a flowchart for explaining the first embodiment. A series of processes illustrated in the flowchart of FIG. 10 are executed by the print controller 202 deploying program codes stored in the ROM 203 to the RAM 204. Alternatively, part or all of the functions in the steps in FIG. 10 may be implemented with hardware, such as an ASIC or an electronic circuit.

At S1002, the print mode set by the user (or the print mode based on the information on printing) is acquired. Specifically, the conveyance control unit 207 acquires the print mode based on the information outputted by the controller unit 100. Then, the conveyance control unit 207 acquires information on the conveyance speed determined by the print mode (hereinafter referred to as "the conveyance speed determined by the print mode" as appropriate). The ROM 203 stores the information on the conveyance speed determined by each print mode.

Next, at S1004, the conveyance control unit 207 judges whether the conveyance speed determined by the print mode (the print conveyance speed) is lower than a specified speed set in advance. The specified speed is stored, for example, in the ROM 203. The specified speed is a speed at which a print medium S being discharged from the printing apparatus 1 does not buckle on the discharging tray 13 or a print medium stacked on the discharging tray 13, and the discharged print medium S satisfies orderly stacking performance on the discharging tray 13. Note that satisfying orderly stacking performance is defined as, for example, a condition in which a previously-discharged print medium S and a later-discharged print medium S are stacked in an orderly manner such that they are within a predetermined range (for example, within 50 mm in the discharging direction and within 50 mm in the width direction (the direction orthogonal to the discharging direction)). The specified speed in this embodiment is set to 330 mm/s. The specified speed is set to an appropriate value based on the physical properties of the print medium S after printing (the physical properties of the print medium S being discharged), the configuration of the printing apparatus 1 (the apparatus configuration), and other factors.

If it is judged at S1004 that the conveyance speed determined by the print mode (for example, 370 mm/s) is not lower than the specified speed (330 mm/s) (higher than or equal to the specified speed), printing is performed while the print medium S is being conveyed at the conveyance speed (370 mm/s) (S1006). After that, the process proceeds to S1014 described later.

On the other hand, if it is judged at S1004 that the conveyance speed determined by the print mode (for example, 150 mm/s) is lower than the specified speed (330 mm/s) (lower than the specified speed), printing is performed while the print medium S is being conveyed at the conveyance speed (150 mm/s) (S1008). After that, it is judged at S1010 based on the detection results of the detection unit 212 whether the leading end of the print medium S has reached the specified position. If the leading end of the print medium S has reached the specified position, the trailing end of the print medium has passed by a position where printing can be performed by the print head 8. In other words, the print operation for the print medium S has finished.

If it is judged at S1010 that the leading end of the print medium S has reached the specified position, speed increase from the conveyance speed determined by the print mode (150 mm/s) to the specified speed (330 mm/s) starts, and the print medium S is discharged (S1012). Because of the speed increase, the print medium S reaches the specified speed before the leading end of the print medium S comes into contact with the discharging tray 13 or a print medium S stacked on the discharging tray 13. Specifically, at S1012, the conveying rollers 7 and the discharging roller 12 convey the print medium S to the specified position at the conveyance speed determined by the print mode (150 mm/s) by the conveyance control unit 207 controlling the drive unit 211. After that, the speed is increased to the specified speed (330 mm/s) from the specified position, and the print medium S will be discharged onto the discharging tray 13. As described above, in this embodiment, the conveyance control unit 207 functions as a conveyance control section that judges whether the leading end of the print medium S has reached the specified position and increases the conveyance speed of the print medium S from the specified position.

After that, it is judged at S1014 whether to finish printing (the printing process) based on the information on printing. Specifically, the number of print media S on which printing has been performed is counted, and it is judged at S1014 whether this count value has reached at a set number. If it is judged at S1014 that the count value has not reached the set number, the process returns to S1004, and the subsequent processes are executed. If it is judged at S1014 that the count value has reached the set number, the printing process ends.

As has been described above, in the first embodiment, in the case where the print mode for the print medium S specifies that a print medium S should be conveyed at a conveyance speed lower than the specified speed, when the leading end of the print medium S reaches the specified position, the speed is increased to the specified speed, and the print medium S is discharged onto the discharging tray 13. With this operation, the print medium S being discharged does not buckle on the discharging tray 13 or a print medium S stacked on the discharging tray 13 in the first embodiment. Consequently, when print media S are discharged continuously, the occurrence of jamming on the discharging tray 13 is suppressed.

Second Embodiment

Figures 11, 11A:
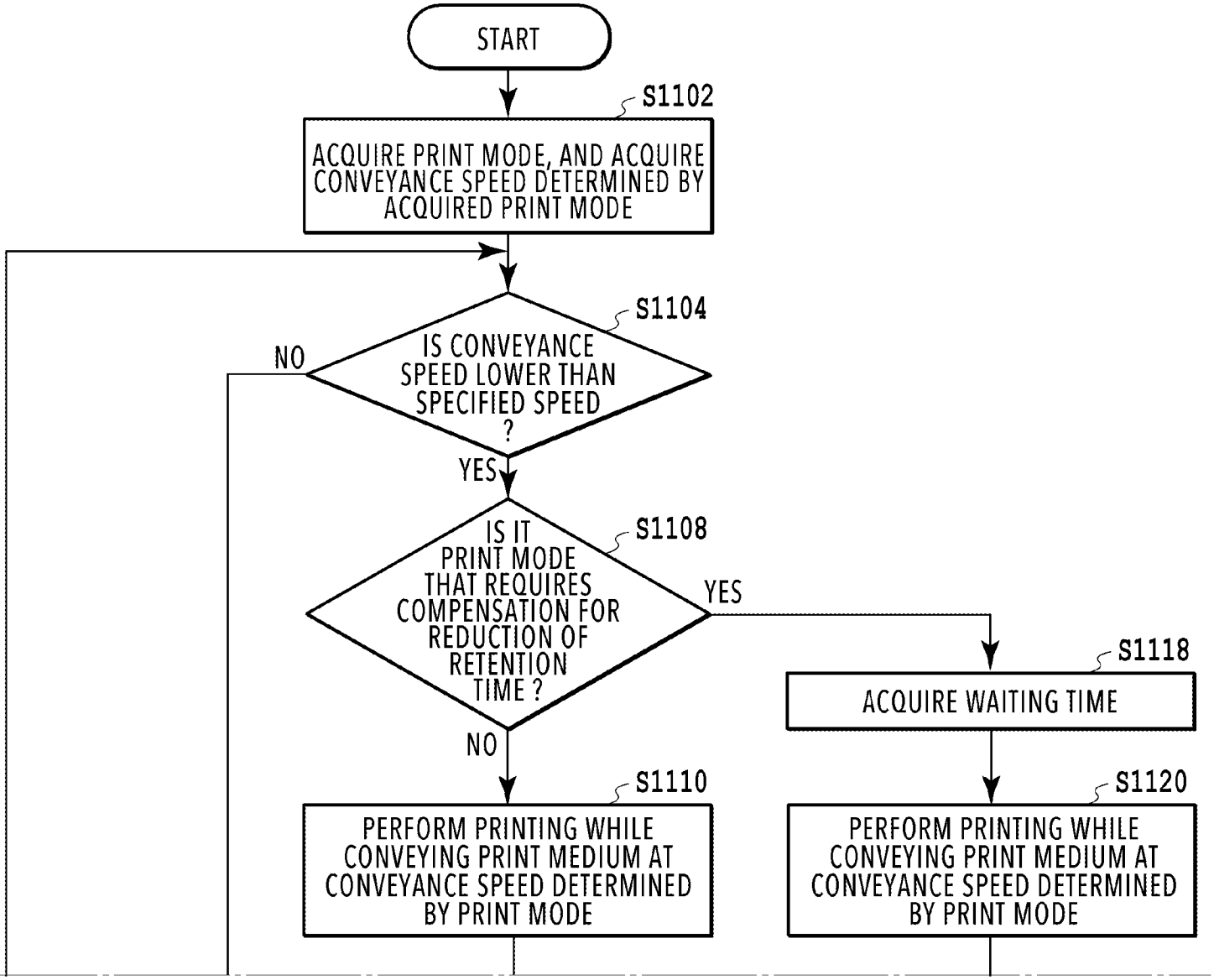
FIG. 11 is a diagram showing a relation between FIG. 11A and FIG. 11B.
FIG. 11A and FIG. 11B are flowcharts for explaining a second embodiment.
Figure 11B:
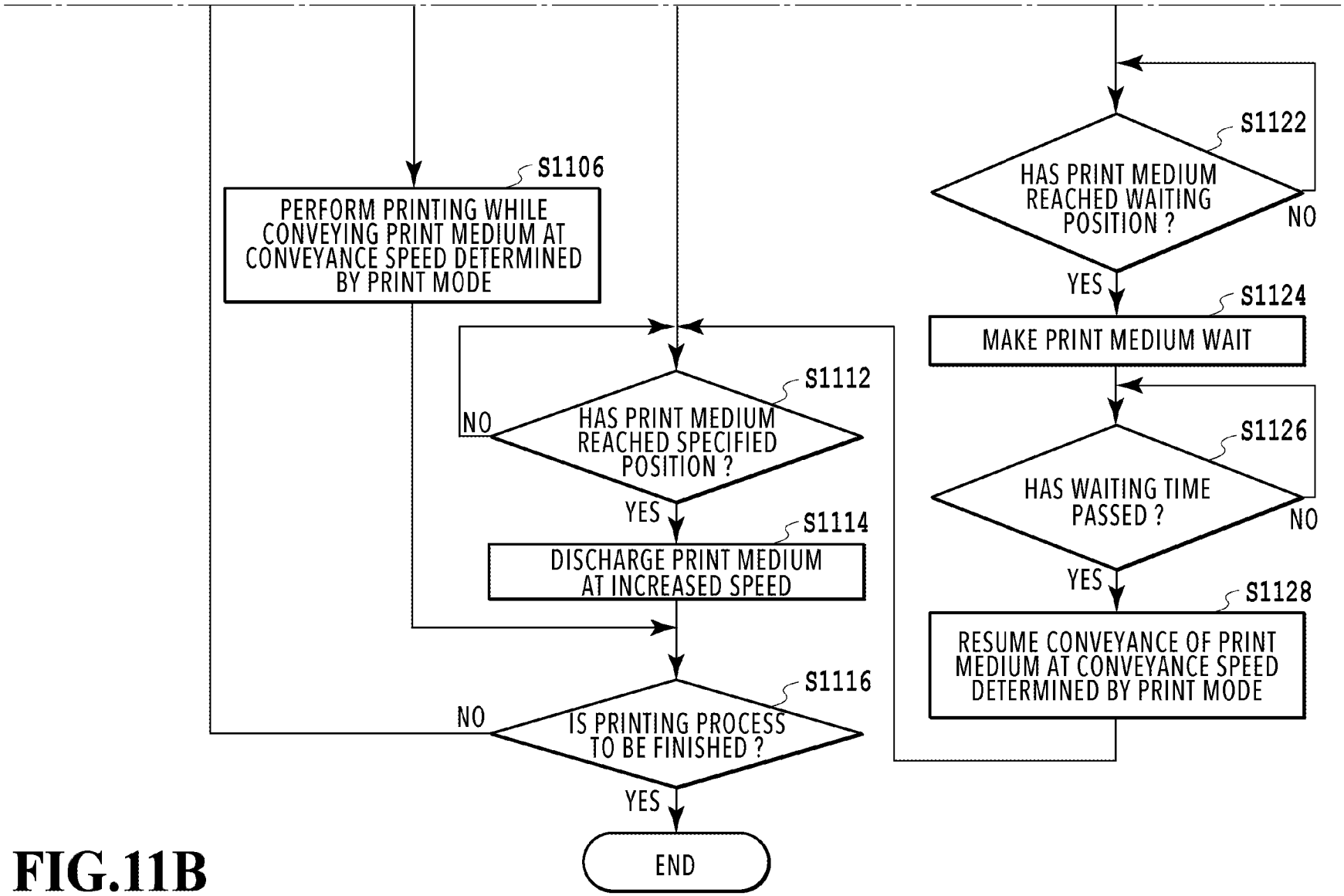

Next, with reference to FIG. 11A and FIG. 11B, description will be provided for a second embodiment of a printing apparatus according to the present invention. Note that constituents the same as or equivalent to those of the first embodiment are denoted by the same reference numerals, and detailed description thereof is omitted as appropriate.

This second embodiment is different from the first embodiment in that part of the retention time for which the print medium S is retained within the conveying path, the part being reduced by the conveyance speed increase from the specified position (the speed increase from the conveyance speed determined by the print mode to the specified speed), is compensated for.

Meanwhile, in the transfer suppression mode and in the curl suppression mode, the print medium S onto which ink has been ejected is retained within the conveying path for a specified time after printing to promote the fixation of ink and suppression of curling while the print medium S is discharged. However, in the first embodiment, in the case where the conveyance speed determined by the print mode is lower than the specified speed, when the leading end of the print medium S reaches the specified position, the speed of the print medium S is increased to the specified speed to discharge the print medium S. Due to this operation, a retention time for which the print medium S is retained within the conveying path (a time for which the print medium S is within the conveying path) is shorter than the specified time.

To address this, in this embodiment, the print medium after printing is made to wait for a specified time to compensate for part of the retention time of the print medium S within the conveying path, the part being reduced by the speed increase to the specified speed from the specified position. Specifically, in this embodiment, in the print modes in which part of the retention time of the print medium S within the conveying path, the part being reduced by the speed increase, needs to be compensated for, the print medium S after printing is made to wait at a waiting position upstream of the specified position for the specified time. Specifically, in the second embodiment, in the case where the current print mode is the transfer suppression mode or the curl suppression mode, the print medium S is made to wait at the waiting position for the specified time (waiting time) to compensate for reduced time by the speed increase from the print conveyance speed to the specified speed from the retention time.

Note that the waiting position is upstream of the specified position in the conveying path, and when the leading end of the print medium S reaches the waiting position, printing on the print medium S by the print head 8 has already finished. It is preferable that the waiting position be a position where the print medium S is held in a straight line in the conveying path to prevent the waiting print medium S from bending (curling), The waiting time differs depending on the conveyance speed determined by the print mode, the length of the conveying path, the specified position, the specified speed, and other factors.

In the second embodiment, in the case where the current print mode is the transfer suppression mode or the curl suppression mode, the waiting time is acquired based on the conveyance speed determined by the print mode or other factors. For example, the waiting time is set to the difference between the time taken to convey the print medium S to the discharging tray 13 at the conveyance speed determined by the print mode and the time taken to convey the print medium S to the specified position at the conveyance speed, and then convey the print medium S from the specified position to the discharging tray 13 at the specified speed. The waiting time is acquired from the calculation by the conveyance control unit 207 based on the length of the conveying path, the conveyance speed determined by the print mode, the specified position, the specified speed, and other factors. For the calculation, coefficients may be prepared according to the surrounding environment (humidity), the amount of ink applied, the kind of the print medium S, the size of the print medium S, and other factors, and the waiting time may be corrected using the coefficients.

FIG. 11A and FIG. 11B are flowcharts for explaining the second embodiment. At S1102, the print mode is acquired, and the conveyance speed determined by the acquired print mode is also acquired. Next, it is judged at S1104 whether the conveyance speed determined by the print mode is lower than the specified speed. If it is judged at S1104 that the conveyance speed determined by the print mode is not lower than the specified speed, printing is performed while the print medium is being conveyed at the conveyance speed determined by the print mode (S1106), and then the process proceeds to 1116 described later. Note that since the concrete process contents in S1102 to S1106 are the same as those in the above S1002 to S1006, respectively, detailed description thereof is omitted.

If it is judged at S1104 that the conveyance speed determined by the print mode is lower than the specified speed, it is judged whether the print mode is a print mode in which reduction of the retention time of the print medium S within the conveying path caused by the speed increase to the specified speed needs to be compensated for (S1108). Specifically, it is judged at S1108 whether the print mode acquired at S1102 is the transfer suppression mode or the curl suppression mode.

If it is judged at S1108 that the acquired print mode is not a print mode that requires the compensation, in other words, the acquired print mode is neither the transfer suppression mode nor the curl suppression mode, printing is performed while the print medium S is being conveyed at the conveyance speed determined by the print mode (S1110). After that, it is judged at S1112 whether the leading end of the print medium S has reached the specified position. If it is judged that the leading end of the print medium S has reached the specified position, the speed increase from the conveyance speed determined by the print mode to the specified speed is started, and the print medium S is discharged (S1114). Then, it is judged at S1116 whether to finish the printing process. Since the concrete process contents in S1110 to S1116 are the same as those in the above S1008 to S1014, respectively, detailed description thereof is omitted.

On the other hand, if it is judged at S1108 that the acquired print mode is a print mode that requires the compensation, in other words, the acquired print mode is the transfer suppression mode or the curl suppression mode, the conveyance control unit 207 acquires the waiting time (S1118). Next, at S1120, printing is performed while the print medium S is being conveyed at the conveyance speed determined by the print mode. After that, it is judged at S1122 whether the leading end of the print medium S has reached the waiting position. Specifically, at S1122, the conveyance control unit 207 judges whether the leading end of the print medium S has reached the waiting position based on detection results of the detection unit 212.

If it is judged at S1122 that the leading end of the print medium S has reached the waiting position, the conveyance control unit 207 controls the conveying rollers 7 to suspend the conveyance of the print medium S and to make the print medium S wait at the waiting position (S1124). Then, at S1126, it is judged whether the waiting time acquired at S1118 has passed (S1126). Specifically, it is judged at S1126 whether the time counted after the leading end of the print medium S has reached the waiting position, has reached the waiting time acquired at S1118. If it is judged at S1126 that the waiting time has passed, the conveyance control unit 207 drives the conveying rollers 7 to resume the conveyance of the print medium S at the conveyance speed determined by the print mode (S1128), and then the process proceeds to S1112.

As has been described above, in the second embodiment, in the case where the conveyance speed determined by the print mode is low, it is judged whether the acquired print mode is a print mode in which the reduction of the retention time of the print medium S within the conveying path caused by the speed increase to the specified speed from the specified position needs to be compensated for. Then, if it is judged that the acquired print mode is a print mode that does not require the compensation, the print medium S is conveyed to the specified position at the conveyance speed determined by the print mode. If it is judged that the acquired print mode is a print mode that requires the compensation, the print medium is conveyed at the conveyance speed determined by the print mode, and then the print medium S is made to wait at the waiting position for the waiting time.

With this operation, the second embodiment provides the same effect as the first embodiment and is also capable of managing the retention time of the print medium S within the conveying path. This makes it possible to surely provide the intended effect in the print modes (the transfer suppression mode, the curl suppression mode) in which the retention time within the conveying path makes difference in the effect. Note that in the second embodiment, since the print medium S is made to wait at the waiting position, there is no constraint (upper limit) on the retention time, regardless of the length of the conveying path. Thus, the second embodiment is capable of achieving the intended object in the print modes described above.

Third Embodiment

Figures 12, 12A:
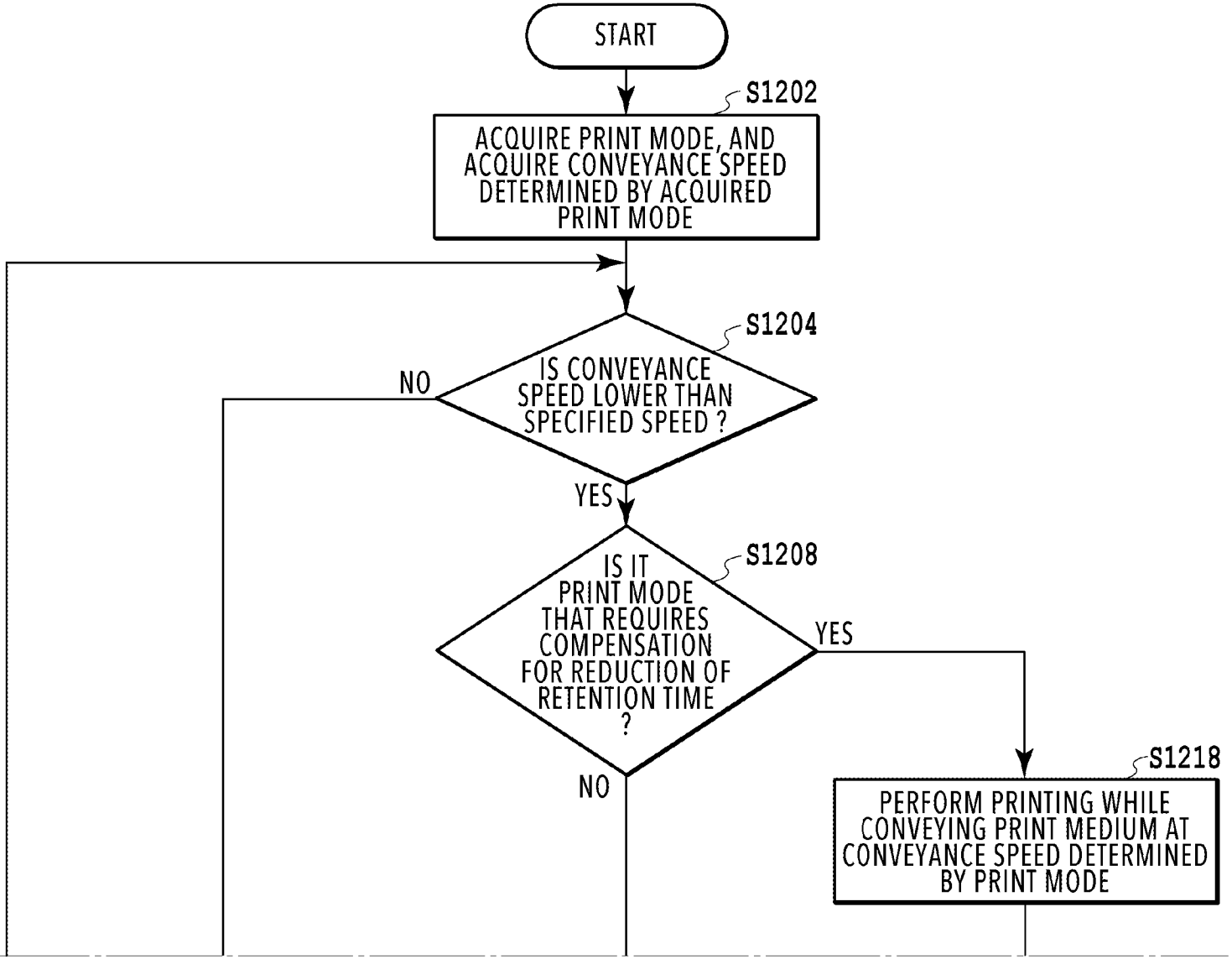
FIG. 12 is a diagram showing a relation between FIG. 12A and FIG. 12B.
FIG. 12A and FIG. 12B are flowcharts for explaining a third embodiment.
Figure 12B:
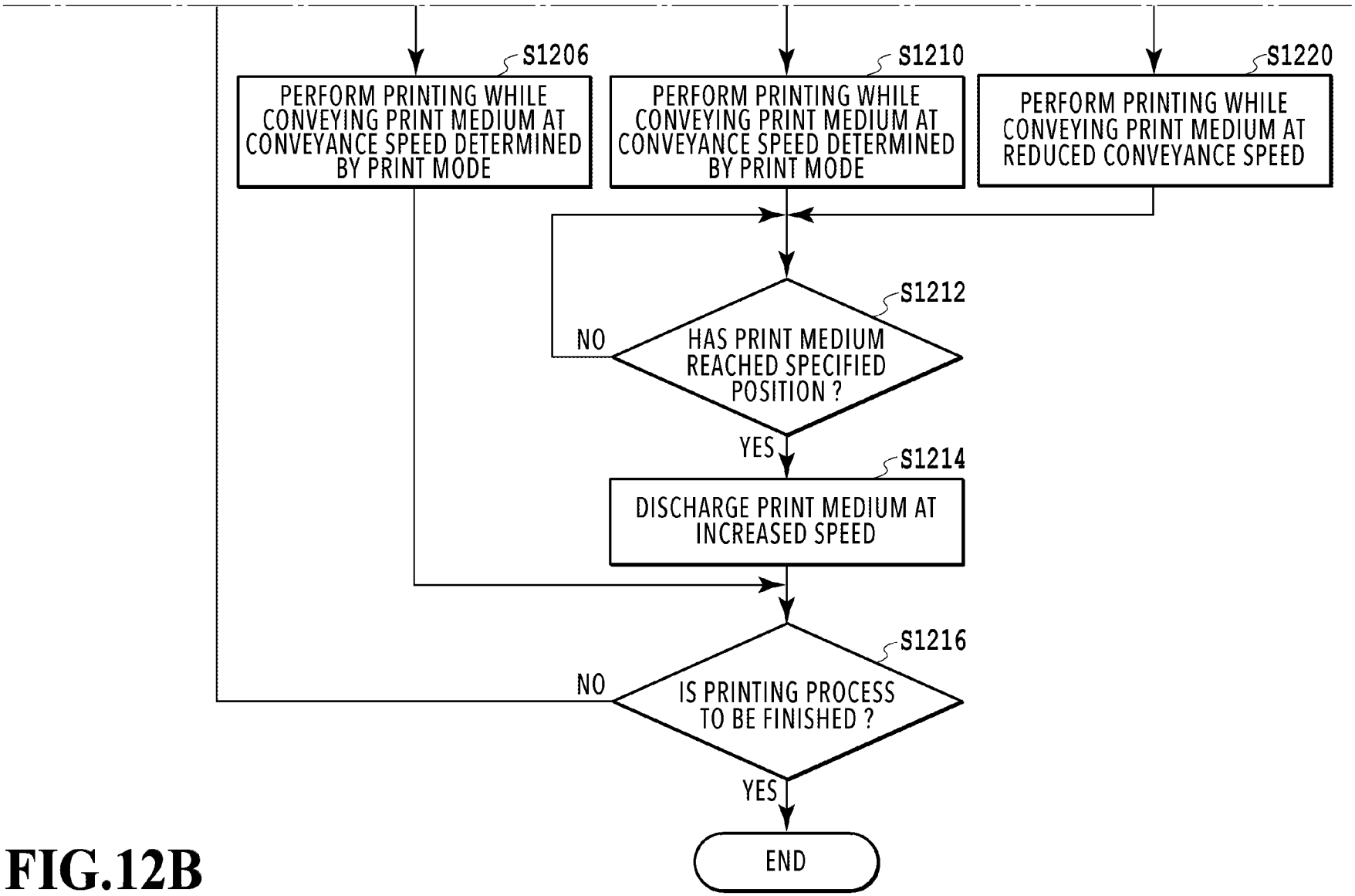

Next, with reference to FIG. 12A and FIG. 12B, description will be provided for a third embodiment of a printing apparatus according to the present invention. Note that constituents the same as or equivalent to those of the first embodiment are denoted by the same reference numerals, and detailed description thereof is omitted as appropriate.

This third embodiment is different from the first embodiment in that part of the retention time of the print medium S within the conveying path, the part being reduced by the conveyance speed increase from the specified position (the speed increase from the conveyance speed determined by the print mode to the specified speed), is compensated for. In addition, the third embodiment is different from the second embodiment in that to retain the print medium S within the conveying path for the specified time, the reduced time is compensated for by reducing the speed from the conveyance speed determined by the print mode.

Specifically, in this embodiment, to compensate for part of the retention time of the print medium S within the conveying path, the part being reduced by the speed increase to the specified speed from the specified position, the speed is reduced from the conveyance speed determined by the print mode. Specifically, in the third embodiment, in the case where the print mode is the transfer suppression mode or the curl suppression mode, the conveyance control unit 207 conveys the print medium S up to the specified position, where the speed increase to the specified speed starts, at a speed reduced from the conveyance speed determined by the print mode. At this time, the speed reduced from the conveyance speed is speed to compensate for reduced time by the speed increase from the conveyance speed to the specified speed from the retention time.

In the third embodiment, the reduced conveyance speed is determined such that the time taken to convey the print medium S up to the specified position at the speed reduced from the conveyance speed determined by the print mode, and then convey it from the specified position to the discharging tray 13 at the specified speed is equal to the time taken to convey the print medium S to the discharging tray 13 at the conveyance speed. In this case, these two times do not have to agree with each other strictly, but it may be judged that they agree with each other when these two times are within a specified range. Note that the reduced conveyance speed is acquired, for example, from the calculation by the conveyance control unit 207 based on the length of the conveying path, the conveyance speed determined by the print mode, the specified position, the specified speed, and other factors. For the calculation, coefficients may be prepared according to the surrounding environment (humidity), the amount of ink applied, the kind of the print medium S, the size of the print medium 5, and other factors, and the reduced conveyance speed may be corrected using the coefficients.

FIG. 12A and FIG. 12B are flowcharts for explaining the third embodiment. At S1202, the print mode is acquired, and the conveyance speed determined by the acquired print mode is also acquired. Next, it is judged at S1204 whether the conveyance speed determined by the print mode is lower than the specified speed. If it is judged at S1204 that the conveyance speed determined by the print mode is not lower than the specified speed, printing is performed while the print medium is being conveyed at the conveyance speed determined by the print mode (S1206), and then the process proceeds to 1216 described later. Note that since the concrete process contents in S1202 to S1206 are the same as those in the above S1002 to S1006, respectively, detailed description thereof is omitted.

If it is judged at S1204 that the conveyance speed determined by the print mode is lower than the specified speed, it is judged whether the print mode is a print mode in which reduction of the retention time of the print medium S within the conveying path caused by the speed increase to the specified speed needs to be compensated for (S1208). Since the concrete process contents in S1208 are the same as those in S1108, detailed description thereof is omitted.

If it is judged at S1208 that the acquired print mode is not a print mode that requires the compensation, in other words, the acquired print mode is neither the transfer suppression mode nor the curl suppression mode, printing is performed while the print medium S is being conveyed at the conveyance speed determined by the print mode (S1210). After that, it is judged at S1212 whether the leading end of the print medium S has reached the specified position, if it is judged that the leading end of the print medium S has reached the specified position, the speed increase from the conveyance speed determined by the print mode to the specified speed is started, and the print medium S is discharged (S1214). Then, it is judged at S1216 whether to finish the printing process. Since the concrete process contents in S1210 to S1216 are the same as those in the above S1008 to S1014, respectively, detailed description thereof is omitted.

On the other hand, if it is judged at S1208 that the acquired print mode is a print mode that requires the compensation, in other words, the acquired print mode is the transfer suppression mode or the curl suppression mode, the conveyance speed reduced from the conveyance speed determined by the print mode is acquired (S1218). After that, at S1120, printing is performed while the print medium S is being conveyed at the reduced conveyance speed, and then the process proceeds to S1212.

As has been described above, in the third embodiment, in the case where the conveyance speed determined by the print mode is low, it is judged whether the acquired print mode is a print mode in which the reduction of the retention time of the print medium S within the conveying path caused by the speed increase to the specified speed from the specified position needs to be compensated for. Then, if it is judged that the acquired print mode is a print mode that does not require the compensation, the print medium S is conveyed to the specified position at the conveyance speed determined by the print mode. If it is judged that the acquired print mode is a print mode that requires the compensation, the print medium S is conveyed up to the specified position at a speed reduced from the conveyance speed determined by the print mode.

With this operation, the third embodiment provides the same effect as the first embodiment and is also capable of managing the retention time of the print medium S within the conveying path. This makes it possible to surely provide the intended effect in the print mode (the transfer suppression mode, the curl suppression mode) in which the retention time in the conveying path makes difference in the effect.

Other Embodiments

Note that the above embodiments may be modified as described in the following (1) to (5).

(1) As described above, the print medium S absorbs moisture in the air under high humidity environment, which decreases the rigidity and increases the friction coefficient the print medium S regardless of the amount of ink applied. Thus, printing apparatuses to which the present invention is applicable are not limited only to inkjet printing apparatuses, but the present invention is applicable to printing apparatuses that perform printing on print media S by various methods. Printing apparatuses to which the present invention is applicable are not limited to what are called full line inkjet printing apparatuses as in the above embodiments, but the present invention is also applicable, for example, to serial inkjet printing apparatuses.

(2) The present invention may be applied to conveying apparatuses. In other words, the conveyance control unit 207, the above conveying mechanism, and other parts may compose a conveying apparatus that conveys the print medium S. The present invention is applicable not only to printing apparatuses that perform printing on print media but also, for example, to various processing apparatuses that perform predetermined processes on print media, such as image scanning apparatuses that scan images printed on print media.

(3) It is assumed in the above embodiments that the discharge mode of the print medium S is face-down discharging, but the present invention is not limited to this mode. The discharge mode may be face-up discharging in which the print medium S is discharged with the printed surface facing up. In addition, in the above embodiments, one or more processes executed by the conveyance control unit 207 may be executed by the print controller 202, such as acquisition of the print mode, the judgement of comparison between the conveyance speed determined by the print mode and the specified speed, and the judgement whether the print medium S has reached the specified position.

(4) Although not described specifically in the above embodiments, the specified position may be a position unique to each print mode or may be a position common to all the print modes. In addition, although not described specifically in the above embodiments, when the print medium S is discharged at the speed increased to the specified speed, the speed may be reduced by the discharging roller 12 just before the trailing end of the print medium S is discharged, to improve the orderly stacking performance. Specifically, when the trailing end of the print medium S is at a specified position upstream of the discharging roller 12 (for example, at a position a few millimeters away from the nip portion between the discharging roller 12 and the spur 7*b*), the speed reduction down to a target conveyance speed is completed.

(5) Although in the above embodiments, it is judged whether the leading end of the print medium S has reached the specified position, the present invention is not limited to this operation. It may be judged whether the trailing end of the print medium S has reached a specified position. Although in the second embodiment, the waiting time is calculated based on the conveyance speed determined by the print mode, the length of the conveying path, and other factors, and the calculated waiting time is corrected according to the surrounding environment, the amount of ink applied, and other factors, the present invention is not limited to this operation. Specifically, the waiting time may be set in advance based on the surrounding environment, the amount of ink applied, the kind of the print medium S, the size of the print medium S, and other factors. In that case, an adjustment value may be calculated based on information such as the conveyance speed determined by the print mode, the length of the conveying path, the specified position, and the specified speed, and then the calculated adjustment value may be added to the waiting time to correct the waiting time.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s)

and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-060491, filed Mar. 27, 2018, which is hereby incorporated by reference herein in its entirety.

What is claimed is:

1. A conveyance apparatus comprising:

a conveying unit configured to convey a print medium; and a drive unit configured to drive the conveying unit such that the conveying unit conveys the print medium in a first direction at a print conveyance speed while a print head, which has a plurality of ejecting openings arrayed in a second direction intersecting the first direction, performs a printing operation for ejecting ink from the ejection openings on the print medium without moving in the first direction, and after the printing operation, the conveying unit conveys the print medium to a discharging tray, wherein the drive unit drives the conveying unit such that in a case in which the print conveyance speed in the printing operation is slower than a specified speed, after the printing operation, the conveying unit discharges the print medium, on which the printing operation has been performed with conveyance at the print conveyance speed, to the discharging tray at the specified speed faster than the print conveyance speed in the printing operation, and in a case in which the print conveyance speed in the printing operation is faster than or equal to the specified speed, after the printing operation, the conveying unit discharges the printing medium to the discharging tray at the print conveyance speed.

2. The conveyance apparatus according to claim 1, wherein in a print mode in which the print medium is required to be retained within a conveying path during a retention time, the drive unit makes the print medium wait at a waiting position for a specified time after the printing operation, and the specified time is time to compensate for a potential reduction of the retention time due to a speed increase from the print conveyance speed to the specified speed.

3. The conveyance apparatus according to claim 2, wherein the waiting position is upstream of a specified position in the conveying path at which the speed increase to the specified speed starts.

4. The conveyance apparatus according to claim 1, wherein in a print mode in which the print medium is required to be retained within a conveying path during a retention time, the conveying unit conveys the print medium at a speed reduced from the print conveyance speed up to a specified position at which a speed increase to the specified speed starts, and the speed reduced from the print conveyance speed is a speed to compensate for a potential reduction of the retention time due to the speed increase from the print conveyance speed to the specified speed.

5. The conveyance apparatus according to claim 1, wherein in the case in which the print conveyance speed in the printing operation is slower than the specified speed, when the print medium after printing reaches a specified position, the drive unit starts a speed increase from the print conveyance speed to the specified speed.

6. The conveyance apparatus according to claim 1, wherein the specified speed varies depending on a physical property of the print medium after the printing operation.

7. The conveyance apparatus according to claim 6, wherein the physical property varies depending on a kind of the print medium, a size of the print medium, surrounding environment, and the amount of ink applied.

8. The conveyance apparatus according to claim 6, wherein the physical property includes at least one of rigidity of the print medium and a friction coefficient of the print medium.

9. The conveyance apparatus according to claim 1, wherein the specified speed is a speed that does not cause buckling of the print medium after printing in a case of the print medium after printing being discharged at the speed onto the discharging tray or the print medium being stacked on the discharging tray.

10. The conveyance apparatus according to claim 9, wherein the specified speed is a speed that allows the discharged print medium to be stacked within a specified range in an orderly manner in the case of the print medium on which an image is printed being discharged onto the discharging tray or onto another print medium stacked on the discharging tray.

11. The conveyance apparatus according to claim 1, wherein the drive unit reduces the speed of the print medium just before a trailing end of the print medium is discharged.

12. The conveyance apparatus according to claim 1, wherein the print medium is discharged with a printed surface facing down.

13. The conveyance apparatus according to claim 1, further comprising the print head.

14. A method of controlling a conveyance apparatus including a conveying unit configured to convey a print medium, and a drive unit configured to drive the conveying unit such that the conveying unit conveys the print medium in a first direction at a print conveyance speed while a print head, which has a plurality of ejecting openings arrayed in a second direction intersecting the first direction, performs a printing operation for ejecting ink from the ejection openings on the print medium without moving in the first direction, and after the printing operation, the conveying unit conveys the print medium to a discharging tray, the method comprising:

a step in which the drive unit drives the conveying unit such that in a case in which the print conveyance speed in the printing operation is slower than a specified speed, after the printing operation, the conveying unit discharges the print medium, on which the printing operation has been performed with conveyance at the print conveyance speed, to the discharging tray at the specified speed faster than the print conveyance speed in the printing operation, and in a case in which the print conveyance speed in the printing operation is faster than or equal to the specified speed, after the printing operation the conveying unit discharges the printing medium to the discharging tray at the print conveyance speed.

15. A non-transitory computer readable storage medium storing a program for causing a computer to perform a method of controlling a conveyance apparatus including a conveying unit configured to convey a print medium, and a drive unit configured to drive the conveying unit such that the conveying unit conveys the print medium in a first direction at a print conveyance speed while a print head, which has a plurality of ejecting openings arrayed in a second direction intersecting the first direction, performs a printing operation for ejecting ink from the ejection openings on the print medium without moving the print head in the first direction, and after the printing operation, the conveying unit conveys the print medium to a discharging tray, the method comprising:

causing a computer included in the conveyance apparatus to perform a step in which the drive unit drives the conveying unit such that in a case in which the print conveyance speed in the printing operation is slower than a specified speed, after the printing operation, the conveying unit discharges the print medium, on which the printing operation has been performed with conveyance at the print conveyance speed, to the discharging tray at the specified speed faster than the print conveyance speed in the printing operation, and in a case in which the print conveyance speed in the printing operation is faster than or equal to the specified speed, after the printing operation, the conveying unit discharges the printing medium to the discharging tray at the print conveyance speed.

* * * * *